United States Patent [19]

Linn

[11] 4,112,266

[45] Sep. 5, 1978

[54] APPLIANCE TIMER WITH CONTACT MOUNTING FOR FLEXIBLE CONTACTS

[76] Inventor: Wallace Leon Linn, 6705 Grosvenor Pl., Indianapolis, Ind. 46220

[21] Appl. No.: 771,406

[22] Filed: Feb. 23, 1977

Related U.S. Application Data

[63] Continuation-in-part of Ser. No. 647,791, Jan. 9, 1976, Pat. No. 4,060,702.

[51] Int. Cl.[2] ..... H01H 43/00; H01H 1/24

[52] U.S. Cl. ..... 200/38 C; 200/283

[58] Field of Search ..... 200/1 A, 38 R, 38 B, 200/38 BA, 38 C, 38 CA, DIG. 46, 283, 38

[56] References Cited

U.S. PATENT DOCUMENTS

| | | | |
|---|---|---|---|
| 2,069,162 | 1/1937 | Hailes | 200/283 X |
| 2,548,103 | 4/1951 | French | 200/1 A X |
| 3,144,524 | 8/1964 | Hawley et al. | 200/283 X |
| 4,052,581 | 10/1977 | Matsui | 200/283 |
| 4,060,702 | 11/1977 | Linn | 200/38 C X |

*Primary Examiner*—James R. Scott

*Attorney, Agent, or Firm*—Jenkins, Coffey & Hyland

[57] ABSTRACT

An appliance timer includes a disc-shaped program wheel. The distal ends of a plurality of resilient wire switches include a plurality of followers which extend into grooves provided in the program wheel. The bottoms of the grooves provide surfaces for controlling operation of the switches to control the appliance. The proximal ends of the switches are mounted in a terminal block in the appliance timer housing. The proximal ends of the switch components are rigidly mounted in the terminal block. The terminal block also includes longitudinally extending channels in which the various movable switch components rest. The channels provide for limited free travel of the movable switch components during their operation.

21 Claims, 10 Drawing Figures

APPLIANCE TIMER WITH CONTACT MOUNTING FOR FLEXIBLE CONTACTS

CROSS REFERENCE TO RELATED APPLICATIONS

This application is a continuation - in - part of U.S. Patent application Ser. No. 647,791, filed Jan. 9, 1976, now U.S. Pat. No. 4,060,702.

BACKGROUND OF THE INVENTION

This invention deals with timers, and more specifically with appliance cycle timer control mechanisms and drive mechanisms.

As the variety of demands made upon modern appliances has increased, so have the requirements made upon appliance cycle timers. For example, modern washing machines capable of washing various types of synthetic fabrics must be able to follow relatively complex washing cycle instructions in order to wash such synthetic fabrics properly. Appliances must be capable of carrying out such cycles without being attended by an operator.

As the cycle timer requirements have become more complex and demanding, cycle timers have, of course, become more complex to manufacture, adjust and install in the appliances. This increased complexity has resulted in increased cost. Further, in order to house the necessary equipment to achieve the complex cycles demanded, it has been necessary either to increase the size of appliance timers or, if the external size of the timer is required to remain constant, to decrease the size of the various internal timer components. Such a decrease in size can result in more fragile timer internal components which are more susceptible to breakage during appliance operation. Additionally such small components are frequently more expensive to manufacture and assemble, further adding to appliance cost.

Miniaturization of many appliance timer components has also been limited by the increased demand which modern appliances frequently place upon such timer components as, for example, on-off switches. Many of the necessary switches in appliance timers are now required to carry higher currents than they have in past appliances due to the increased work which the appliances are required to do. For example, the larger washing machines of today must carry larger loads of washing through a number of washing and spinning cycles. The size of the wash load often requires that the electric motor used in the washer be a higher current motor. Motor current may have to be switched several times by on-off switches housed within the appliance timer during the washing cycle.

SUMMARY OF THE INVENTION

Accordingly, it is an object of the present invention to provide an appliance cycle timer which is simple and economical to manufacture, and which incorporates an ample amount of program capacity to provide the required complex cycling.

It is a further object of the present invention to provide such a cycle timer in which connections to the various switches are readily accessible from outside the timer housing, allowing the switch components to be wired in various combinations to meet the cycle timing requirements of a multiplicity of applications.

In the illustrated embodiment of the present invention, a timer for controlling the operating cycle of an appliance includes a program wheel mounted for rotation, switching means for initiating the various portions of the appliance operating cycle, means for rotating the program wheel, the wheel having a plurality of concentric and continuous grooves in its surfaces, the bottom of each groove defining a program controlling surface, and means for following each program controlling surface, the following means being coupled to the switching means for controlling the operating cycle of the appliance. Each switching means includes at least one pole member and at least one throw member, the pole and throw members being formed from lengths of resilient wire having proximal ends fixedly mounted in a terminal block and accessible from the outside of the appliance timer housing so that the various switch members may be coupled to one another readily to adapt the timer to a particular timing application. The distal ends of the throw members of the switches are formed to provide the following means, which following means are retained in the grooves, the throw members being formed and mounted yieldably to urge the following means against the groove bottoms to maintain contact spacing and alignment.

According to the present invention, intermediate portions of the resilient wire pole members rest in channels provided for them in the terminal block, such channels providing for limited movement of such pole members in contact with respective ones of the throw members, and additional channels provide for limited movement of the throw members in the directions in which their respective pole members move.

BRIEF DESCRIPTION OF THE DRAWINGS

Other and further objects of the present invention will become apparent to those skilled in the art to which this invention pertains by referring to the following description and the accompanying drawings in which.

Figure 1:
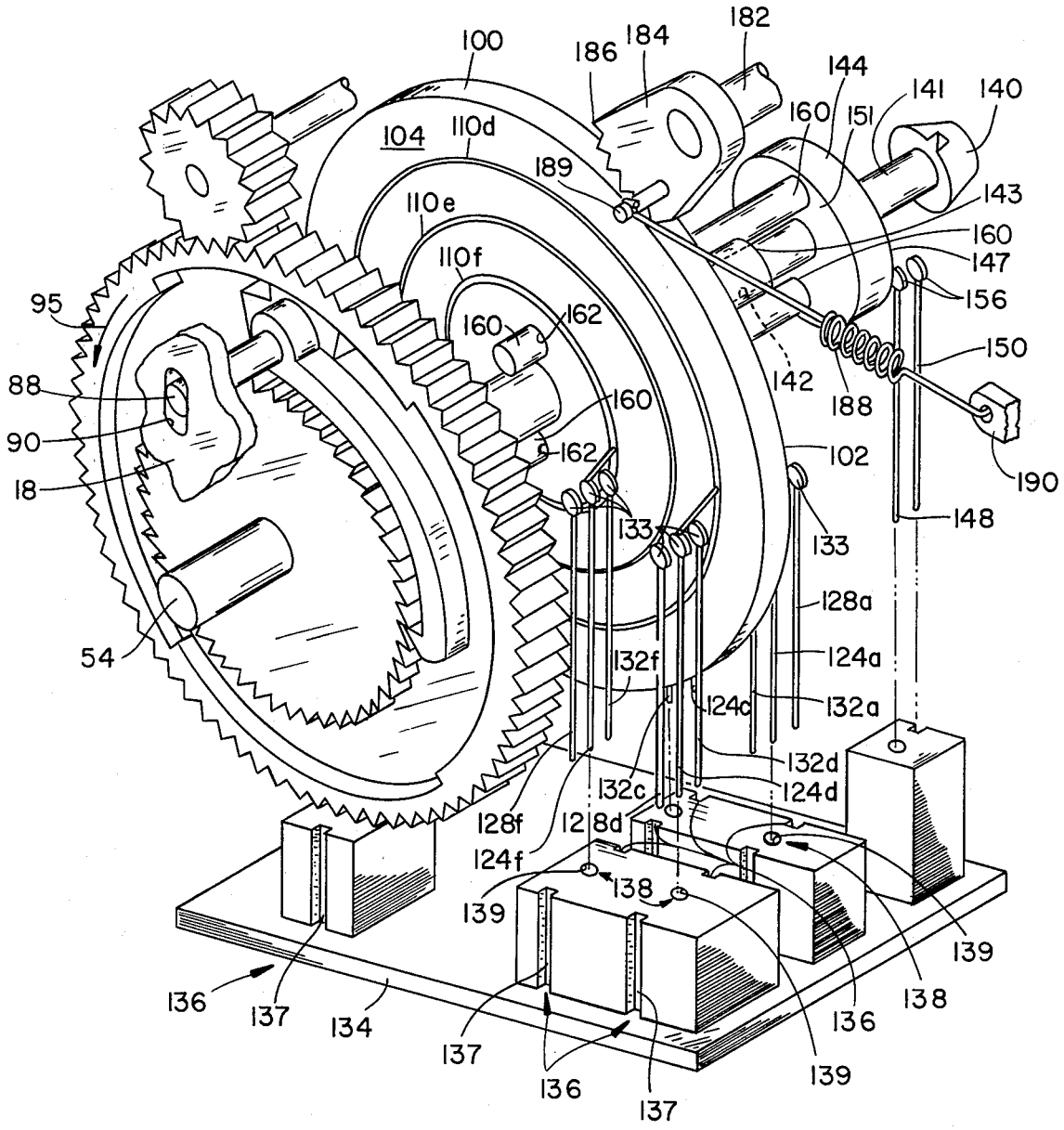
FIG. 1 is an exploded perspective view of various elements of a cycle timer constructed in accordance with the present invention.
Figure 3:
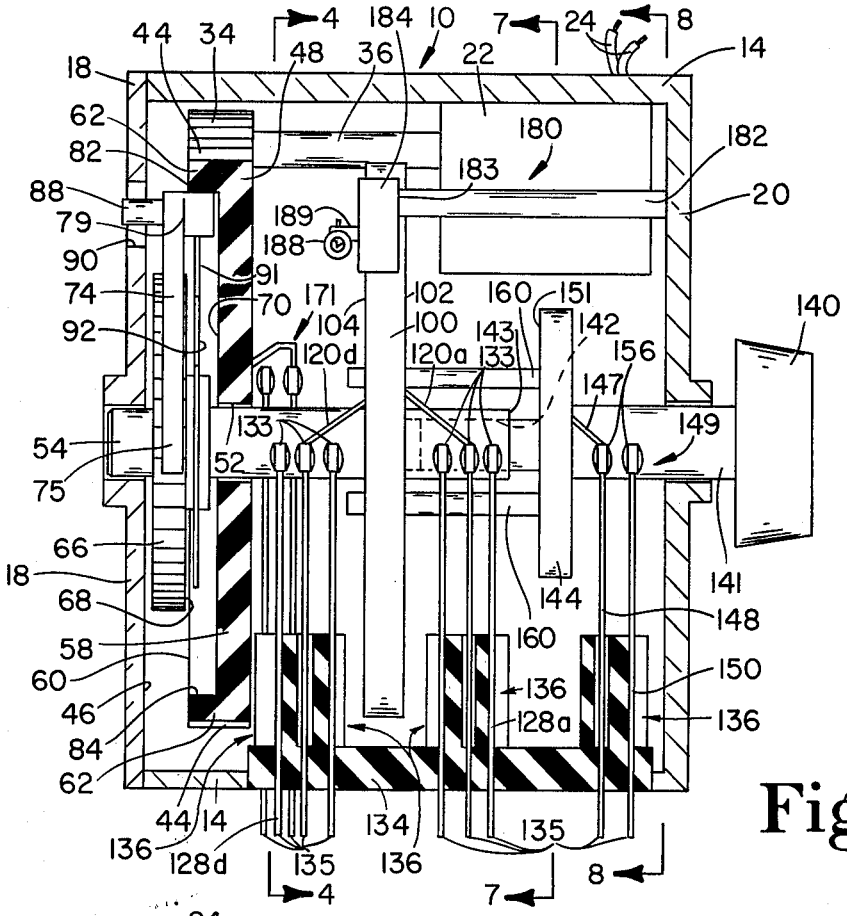
FIG. 3 is a sectional view of the cycle timer of FIGS. 1–2 taken generally along section lines 3—3 of FIG. 2.
Figure 4:
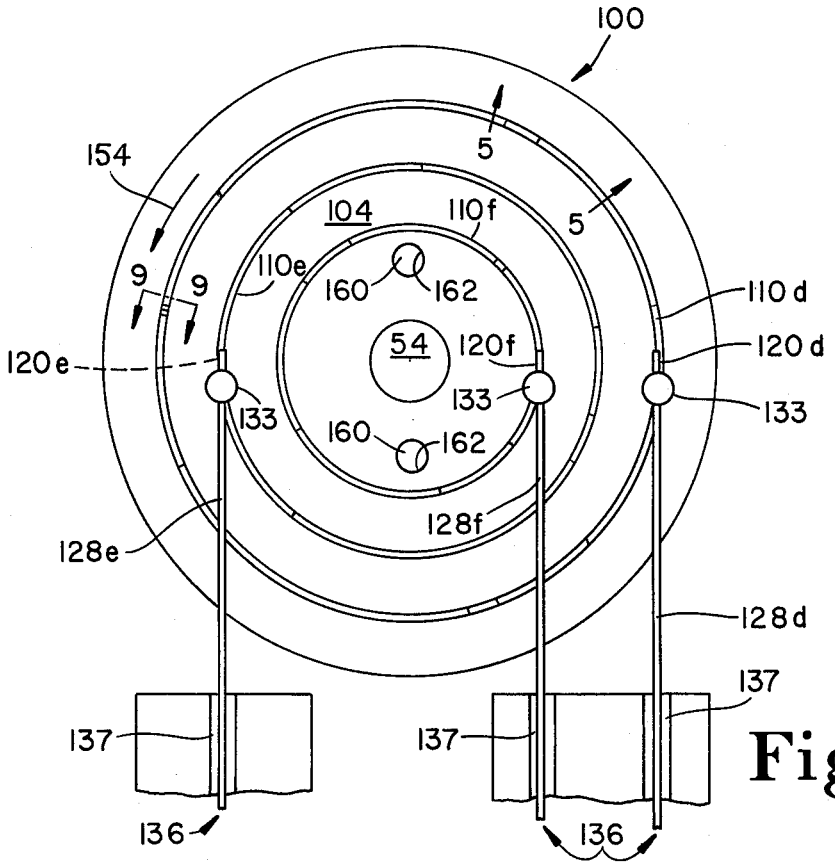
FIG. 4 is a fragmentary sectional view of a part of the timer taken generally along section lines 4—4 of FIG. 3.
Figure 8:
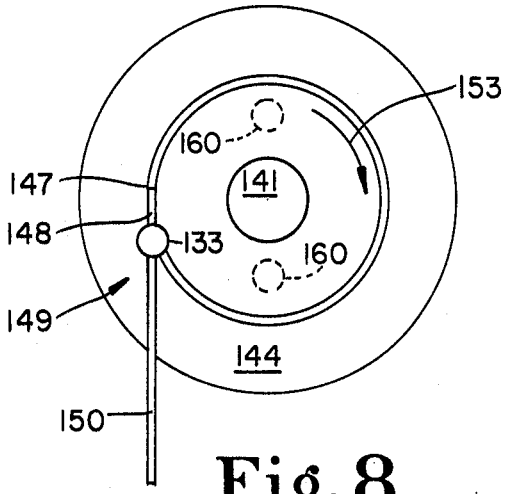
Figure 9:
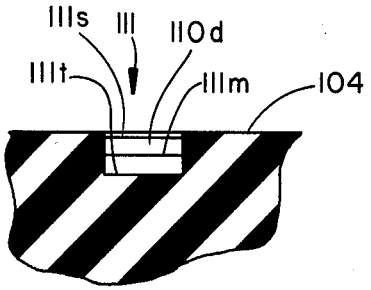
Figure 7:
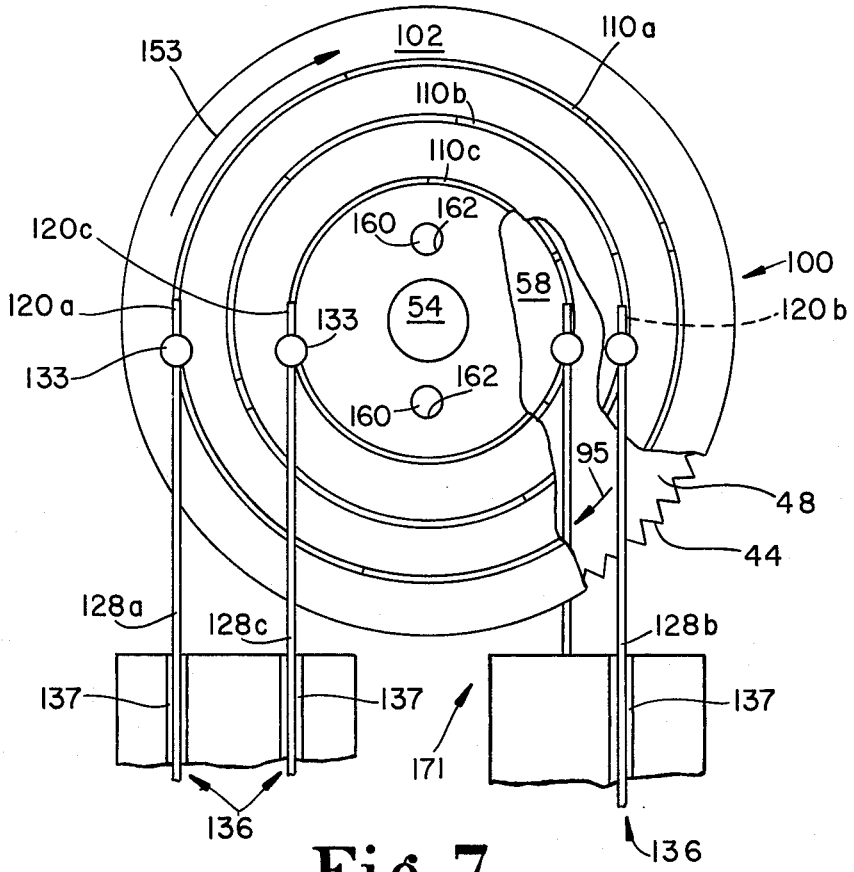

FIGS. *6a–b* are fragmentary views of parts of the timer illustrated in FIGS. 1 and 3;

FIG. 7 is a fragmentary partial sectional view of the timer taken generally along section lines 7—7 of FIG. 3;

FIG. 8 is a partial sectional view of the timer taken generally along section lines 8—8 of FIG. 3; and FIG. 9 is a fragmentary partial sectional view of the timer taken along section lines 9—9 of FIG. 4.

DETAILED DESCRIPTION OF A PREFERRED EMBODIMENT

Referring now to the drawings, the appliance timer 10 of the preferred embodiment includes a housing 12 comprising a front half 14 and a rear half 18. Shown diagrammatically interiorly of the front face 20 of housing half 14 is a constant speed motor and gear train assembly 22. Motor and gear train 22 is actuated by applying line voltage to motor coil wires 24 to drive a gear 34 situated at the opposite end of a shaft 36. It will be appreciated that any number of constant speed motor assemblies may be used with the timer 10. The housing 12 and even the motor assembly 22 are axially elongated in the accompanying drawings to facilitate the showing of the components.

Gear 34 engages a constant speed drive ring gear 44 which lies adjacent the rearward interior face 46 of housing 12. Ring gear 44 is formed about the exterior periphery of a cylindrical drive member 48. Drive member 48 comprises a collar 52 which is rotatably received on a driven, or output shaft 54. Shaft 54 is generally centrally disposed within the housing 12 and runs from the front to the back thereof. Drive member 48 further includes a cylindrical wall 62 coaxial with shaft 54, a generally circular closed front end 58 and an open rearward end 60.

The coupling of the constant speed motor and gear train 22 through shaft 36 and gear 34 insures that ring gear 44 and drive member 48 rotate at constant speed.

A ratchet wheel 66 having a front face 68 and its pawl 74 are enclosed between a rearward surface 70 of drive member 48 and housing surface 46. The proximal end 75 of pawl 74 engages one of the radially outwardly directed teeth 78 of ratchet 66. The distal end 79 of pawl 74 provides a cam follower 82.

Cam follower 82 is proportioned and designed to follow the camming surfaces 84 formed by a plurality of cam lobes 87 which extend radially inwardly from the interior of the generally cylindrical wall 62. The motion of pawl 74 as follower 82 rides against cam surfaces 84 is limited by a pin 88 which is attached to the distal end 79 of pawl 74 and extends through an elongated slot 90 in the rear housing half 18.

Figure 2:
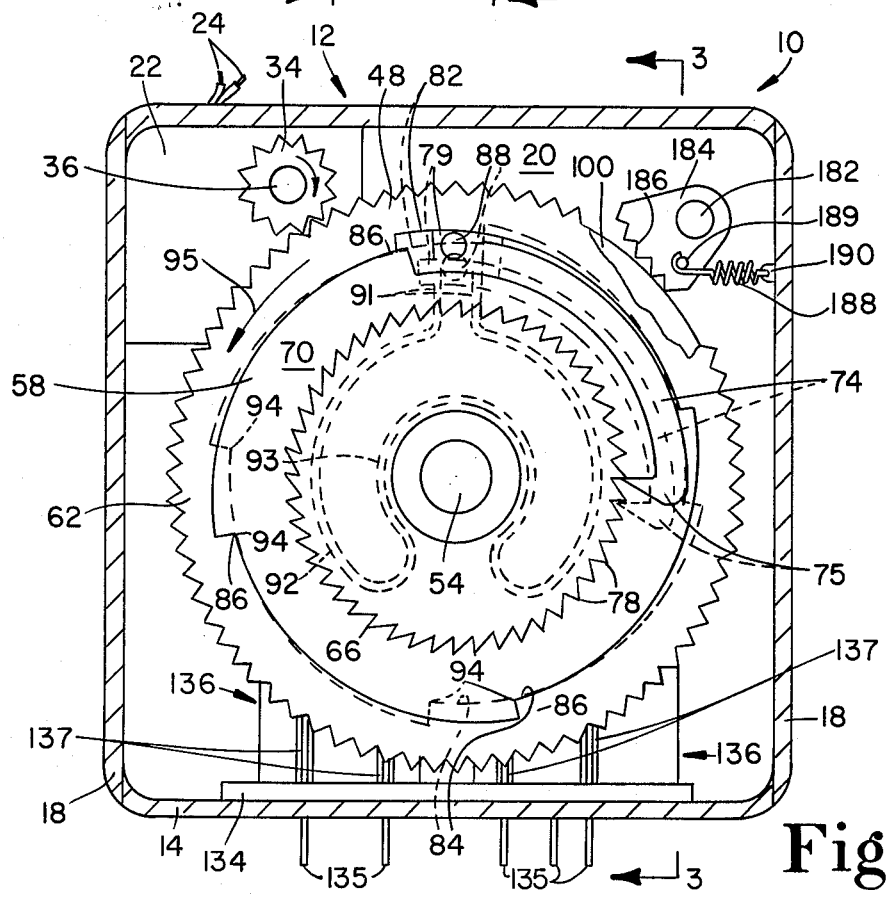
FIG. 2 is a fragmentary and sectioned rear elevational view of the cycle timer of FIG. 1.

Follower 82 is urged against cam surface 84 by the ends 91 of a cardioid wire spring 92 having a loop 93 which positions the spring relative to shaft 54. The force exerted by spring 92 on follower 82 as the follower is forced radially inwardly of drive member 48 by cam surfaces 84 is substantially constant throughout the follower's motion. Each time follower 82 is urged radially inwardly toward a peak 94 of cam surface 84, proximal end 75 of pawl 74 moves in a forward (downward) stroke illustrated by the dashed line representation of the pawl in FIG. 2 a constant, predetermined distance. Then, as drive member 48 advances in the direction indicated by arrow 95, follower 82 returns from peak 94 to its radially outward position at the base of lobe 87 allowing pawl 74 to complete a return stroke to the position illustrated in solid lines in FIG. 2. As the pawl executes the return stroke, its proximal end 75 engages the next tooth in the clockwise direction of ratchet 66 as shown in FIG. 2. The ratchet 66 thus is turned a predetermined amount with each return stroke of pawl 74. Each return stroke of pawl 74 thus causes a predetermined amount of rotation of output shaft 54.

The escapement mechanism, including driving member 48, ratchet 66, pawl 74 and cardioid spring 92, thus serves both to reduce the rotation rate of the ring gear 44 to a desired rotation rate at output shaft 54 and to convert the constant speed of rotation of ring gear 44 to a stepwise rotation of shaft 54.

Figure 6A:
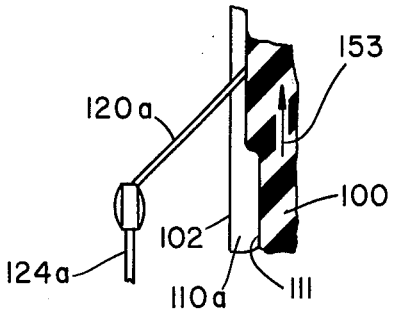
Figure 6B:
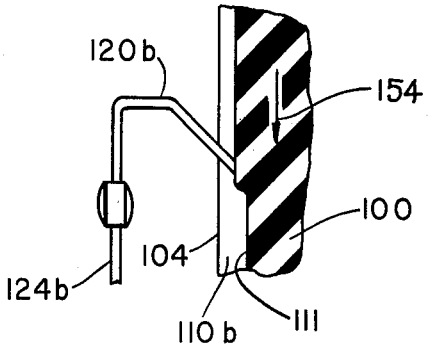
Figure 5:
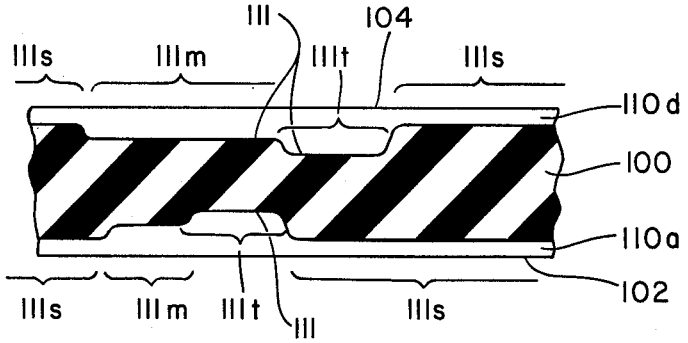
FIG. 5 is a fragmentary sectional view of the portion of the timer taken along section lines 5—5 of FIG. 4.

Rotation of ratchet wheel 66 is transmitted through shaft 54 to a program wheel 100 having two opposite, generally flat axially facing circular sides 102, 104. A plurality of concentric grooves 110*a–c*, 110*d–f* are formed into surfaces 102, 104 respectively. The grooves describe circles on surfaces 102, 104 concentric with shaft 54. As best seen in FIGS. 6*a* and 6*b*, follower end portions 120*a–f* of switch throw members 124*a–f*, respectively, ride in grooves 110*a–f*, respectively. These throw members are desirably resilient wire. Each of switch throw members 124*a–f* has two pole members 128*a–f*, 132*a–f*, respectively, associated therewith, which pole members are also desirably made of resilient wire. As best illustrated in FIGS. 4, 5 and 8, the depths of the grooves 110*a–f* from surfaces 102, 104 to the groove bottoms 111 vary in steps. For example, the shallowest portions 111*s* of the grooves may be 0.015 inch, with the depth of the next step 111*m* being 0.055 inch and the depth of the deepest portion 111*t* of each groove being 0.095 inch. The axially and peripherally extending side walls of the grooves desirably hold and guide followers 120*a–f* so that the followers remain securely in the grooves and the throw members of their respective switches 124*a–f* remain in alignment with their associated pole members 128*a–f*, 132*a–f*.

As follower end portions 120*a–f* of the switch throw members 124*a–f*, respectively, follow the groove bottoms 111, the throw members move from, for example, positions contacting pole members 128*a–f*, corresponding to the shallowest portions 111*s* of the grooves to positions in contact with neither pole members 128*a–f* nor members 132*a–f* corresponding to the intermediate depths 111*m* of the grooves, to positions contacting pole members 132*a–f*, corresponding to the deepest portions 111*t* of the grooves.

Thus, the depth of a groove 110*a–f* determines whether its associated throw member 124*a–f* is in contact with its pole member 128*a–f*, its pole member 132*a–f*, or is in a neutral position between the two sets of pole members and in contact with neither. Any desired switching sequence for the switches can be provided by properly varying the depths of the various grooves.

The proximal ends of the switch throw members 124*a–f* and pole members 128*a–f*, 132*a–f* are all fixedly mounted in a terminal block 134 which is located in the bottom of housing 12. The proximal ends of the pole and throw members all protrude through the block to form terminals 135 providing access to all of the switches on the outside of housing 12. The throw members 124*a–f* are all mounted in the block 134 so that the throw members are biased in such a direction as to urge their followers 120*a–f* against the bottoms 111 of grooves 110*a–f*.

Block 134 includes a plurality of guiding channels 136 in which the intermediate lengths of the various pole members 124*a–f*, 132*a–f* rest. The pole members are formed to urge resiliently against the floors 137 of channels 136. Block 134 also includes a plurality of channels 138 through which the various throw members 124*a–f* extend longitudinally. The illustrated channels 138 are cylindrical bores terminating within block 134, although channels 138 can be formed with any desired cross section. The sidewalls 139 of the bores limit the travel of the throw members 124*a–f* as the throw members respond to motion of the program surfaces. This system provides for good "wiping" contact to be made by the terminals of the various pole and throw members. This system also provides preselected maximums for the motion of the various switch parts as they contact one another. This system of guiding and motion-limiting channels for the pole and throw members in the terminal block permits rapid assembly of the switches into the timer housing with no need for expensive, labor-intensive hand alignment of the pole and throw member wires. Consequently, such timers are more reliable and less expensive to manufacture.

Throw members 124*a–f* and pole members 128*a–f*, 132*a–f* may all be made of the same material. The pole and throw members may be made from, for example, heavy gauge brass wire. The follower end portions 120*a–f* of throw members 124*a–f* may preferably be formed in the distal ends of the lengths of wire from which the throw members are fabricated. Contact points 133 are attached to the distal ends of the pole and throw members. The contact points may be made of suitably shaped pieces of silver or its alloys which may be attached to the pole and throw members by any desired method, such as by soldering or welding.

It should be noted that in the embodiment illustrated in the Figs., and especially in FIGS. 4 and 7, throw members whose followers ride in adjacent grooves on either of surfaces 102, 104 are on alternate sides of the terminal block 134. This location scheme prevents the switches from being located too close together.

Referring now particularly to FIGS. 6*a–b* which show details of the follower end portions 120*a*, 120*b* of two throw members 124*a*, 124*b* respectively, it will be noted that shaft 54 is designed to turn in only one direction. Thus, all of followers 120*a–f* are shaped to take into account the different directions in which program wheel 100 moves relative to them (see direction arrows 95, 153, 154 of the Figs.). As illustrated in FIG. 6*a*, follower 120*a* of throw member 124*a* is formed to allow the follower to provide minimum resistance to motion of program wheel 100 in the direction indicated by arrow 153, the direction in which wheel 100 is driven by rotation of ratchet wheel 66. In FIG. 6*b*, follower 120*b*, which is located on the diametrically opposite side of wheel 100 from follower 120*a*, is formed in the distal end of throw member 124*b* to present minimum resistance to movement of wheel 100 in the direction indicated by arrow 154.

A manual control and selector knob 140 is attached to a stem 141 which is slidingly received in a recess 142 at the forward end 143 of shaft 54. Knob 140 may be pulled outwardly from the front of housing 12. A secondary program wheel 144 is located inside of housing half 14 between front 20 and surface 102. Wheel 144 is attached to knob 140 and slides axially of shaft 54 with knob 140. A program groove 145 similar to grooves 110*a–f*, is located in the front surface 146 of wheel 144. A groove follower 147 formed in the distal end of a throw member 148 of an on-off switch 149 rides in groove 146. Throw member 148 may be formed from the same material and in the same manner as throw members 124*a–f*. A pole member 150, constructed in the same manner as pole members 128*a–f*, 132*a–f* lies behind throw member 148. Throw member 148 and pole member 150 are both mounted in the terminal block 134 in the same way as the other pole and throw members. When control and selector knob 140 is pulled outwardly from housing 12, the contact points 156 of the on-off switch make, energizing motor and gear train 22 and starting the cycle timer. When knob 140 is pushed rearwardly of housing 12, the cycle timer is turned off.

Pins 160 are attached to the rearward surface 151 of wheel 144 and protrude through holes 162 in wheel 100 when knob 140 is in either the forward or rearward position. Thus knob 140 may be manually turned, turning the program wheel 100 so that the appliance timing cycle may be initiated at any desired point.

Of course, additional grooves similar to grooves 110*a–f* may be cut into either or both of surfaces 102, 104. One such timer has been constructed in which eight grooves have been cut into each of sides 102, 104, thereby providing the control for sixteen switches. Additional grooves, such as groove 169 of FIG. 7, may be provided in front surface 58 of drive member 48 to increase the switch capacity of the apparatus. Switches controlled by grooves in surface 58, such as switch 171 of FIGS. 3, 7 will be controlled at a somewhat faster rate than will those switches actuated by program wheel 100, since driving member 48 rotates at the same rate as ring gear 44 and program wheel 100 rotates at the substantially slower rate of ratchet wheel 66.

To prevent program wheel 100 from being rotated in the wrong direction (direction opposite that of arrow 95) by manual turning of knob 140, an anti-reverse brake mechanism 180 is provided. Mechanism 180 comprises a mounting stem 182 which projects rearwardly of housing 12 from the inside of front housing half 14. A brake shoe 184 is rotatably mounted on the distal end 183 of the stem. The working surface 186 of shoe 184 is roughened better to prevent unwanted rotation of program wheel 100. A weak spring 188 is attached between points 189 on shoe 184 and 190 on housing 12 to bias the shoe. The spring weakly biases the shoe to avoid interference with turning of program wheel 100 in the direction of arrow 95 but not sufficiently to bias working surface 186 out of contact with the periphery of wheel 100 so that rotation in the undesirable direction is prevented. It is relatively important that such rotation be prevented since the followers 120*a–f* are suitably shaped to accommodate rotation of wheel 100 in only one direction and to rotate wheel 100 in the opposite direction could result in damage to followers 120*a–f*.

It should further be noted that the appliance timer of the present invention may be driven by a stepper motor, with or without a gear train, instead of the constant speed motor and gear train 22 and escapement mechanism illustrated in the Figs. Also, logic circuitry might be provided to generate the pulses necessary to drive a stepper motor.

It should further be noted that the proximal ends 135 of the pole and throw members which protrude from terminal block 134 to the exterior of housing 12 are ideally suited to be wired to one another as desired, or to receive printed circuit boards. Various ones of the pole and throw members may be wired together or electrically coupled by suitably generated printed circuits to achieve a number of different desirable switching patterns.

It is to be understood that the various parts illustrated in the Figs. may be of different sizes than those here shown. Many of the parts have been expanded in size and particularly in thickness in the axial direction of timer shaft 54 better to illustrate the cooperation and relative locations of the various parts of the timer. It may be appreciated that a timer made in accordance with this specification and the appended claims may be quite narrow in the axial direction along shaft 54. The escapement mechanism is desirably axially narrow and, of course, the program wheel is axially narrow. The switch array is axially narrow. The timer is not only compact, but is also inexpensive to manufacture as compared to conventional appliance timers.

What is claimed is:

1. In an appliance timer comprising a program wheel rotatably mounted within the timer and having a plurality of program controlling surfaces, a plurality of switches, each switch including at least one throw member and one pole member, each said throw member including means defining a proximal end portion, a distal end portion, and an intermediate portion, means defining one each said throw member a contact and a controlling surface follower, each follower responsive to one of said program controlling surfaces for controlling said throw member, the improvement comprising a terminal block for mounting said throw members, the block including a portion for rigidly holding a proximal end portion of each said throw member, the block further including means for defining channels for maintaining alignment and spacing between said throw members during timer operation, said channels extending longitudinally of said throw members, each said channel cooperating with the intermediate portion of one of said throw members.

2. The appliance timer of claim 1 wherein each said pole member includes means defining proximal, intermediate and distal end portions and a contact on the distal end portion, the terminal block including a portion for rigidly holding the proximal end portion of each pole member and channels for maintaining the alignment and spacing between the various pole members, said channels extending longitudinally of said pole members, and each said channel cooperating with the intermediate portion of one of said pole members.

3. The appliance timer of claim 2 wherein each said pole and throw member is formed from a length of resilient wire.

4. The appliance timer of claim 2 wherein the controlling surface followers are formed in the distal ends of various one of the throw members.

5. The appliance timer of claim 2 wherein the proximal end portions of the pole members are mounted in the terminal block to urge the intermediate portions of such pole members resiliently into their respective channels.

6. The appliance timer of claim 2 wherein the channels for the throw members are generally cylindrical and the throw members are mounted in the terminal block to extend generally axially of their respective channels.

7. The appliance timer of claim 2 wherein the channels for the pole members are generally rectangular in cross section.

8. In an appliance timer comprising a program wheel rotatably mounted within the timer and having a plurality of program controlling surfaces, a plurality of switches, each switch including at least one throw member and one pole member, each said pole and throw member including means defining a proximal end portion, a distal end portion, and an intermediate portion, means defining a contact on the distal end portion of each said pole and throw member, means defining on each said throw member a controlling surface follower, each follower responsive to one of said program controlling surfaces for controlling said throw member, the improvement comprising a terminal block for mounting said pole members, the block including a portion for rigidly holding a proximal end portion of each said pole member, the block further including means for defining a channel for maintaining alignment and spacing between said pole members for limiting motion of respective pole members during timer operation, said channels extending longitudinally of said pole members, each said channel cooperating with the intermediate portion of a respective one of said pole members.

9. In an appliance timer comprising a program wheel rotatably mounted within the timer and having a plurality of program controlling surfaces, a plurality of switches, each switch including at least one throw member and one pole member, each said pole and throw member including means defining a proximal end portion, a distal end portion, and an intermediate portion, means defining a contact on the distal end portion of each said pole and throw member, means defining on each said throw member a controlling surface follower, each follower responsive to one of said program controlling surfaces for controlling said throw member, the improvement comprising a terminal block for mounting said pole and throw members, the block including a portion for rigidly holding a proximal end portion of each said pole and throw member, the block further including means for defining a channel for maintaining alignment and spacing between said pole and throw members during their movement and for limiting motion of respective pole members during timer operation, said channels extending longitudinally of said pole and throw members, each said channel cooperating with the intermediate portion of a respective one of said pole and throw members.

10. The appliance timer of claim 9 wherein each said pole and throw member is formed from a length of resilient wire.

11. The appliance timer of claim 9 wherein the controlling surface followers are formed in the distal ends of various ones of the throw members.

12. The appliance timer of claim 9 wherein the proximal end portions of the pole members are mounted in the terminal block to urge the intermediate portions of such pole members resiliently into their respective channels.

13. The appliance timer of claim 9 wherein the channels for the throw members are generally cylindrical and the throw members are mounted in the terminal block to extend generally axially of their respective channels.

14. The appliance timer of claim 9 wherein the channels for the pole members are generally rectagular in cross section.

15. The appliance timer of claim 9 wherein the channel for each of the throw members includes at least one channel wall extending longitudinally of the intermediate portion of the throw member for limiting motion of the throw member intermediate portion in two opposite directions.

16. The appliance timer of claim 15 wherein the channel for each throw member includes a closed channel end adjacent the proximal end portion of the throw member and an open end facing axially of the throw member toward its distal end.

17. The appliance timer of claim 16 wherein the channel for each throw member is generally circular in cross section, the channel wall thereby defining a right circular cylinder.

18. The appliance timer of claim 9 wherein the channel for each pole member includes a channel bottom wall extending longitudinally of the intermediate portion of the pole member for limiting motion of the pole member intermediate portion toward its respective throw member.

19. The appliance timer of claim 18 wherein the channel for each pole member includes a closed channel end adjacent the proximal end portion of the pole member and an open end facing axially of the pole member toward its distal end.

20. The appliance timer of claim 19 wherein the channel for each pole member includes two side walls for guiding the pole member for movement toward and away from its rest position against the channel bottom wall.

21. The appliance timer of claim 19 wherein the channel for each pole member is generally rectangular in cross section.

* * * * *